US007350874B2

(12) United States Patent
Brüggemann et al.

(10) Patent No.: US 7,350,874 B2
(45) Date of Patent: Apr. 1, 2008

(54) METHOD AND DEVICE FOR EXTRACTING EXTRACTION PRODUCTS IN UNDERGROUND MINING

(75) Inventors: Reinhold Brüggemann, Dortmund (DE); Detlef Hahn, Lünen (DE); Frank Fischer, Lünen (DE); Jochen Hammel, Bochum (DE); Jörg Wirtz, Hattingen (DE); Norbert Katthöfer, Lünen (DE); Frank Herrmann, Chemnitz (DE); Hans Tümpner, Aue (DE); Harry Martin, Cranberry Township, PA (US); Juan Delgado, Eagle Pass, TX (US); Victor Raul Encina Montenegro, Providencia/Santiago (CL); Pablo Antonio Letelier Parga, Providencia/Santiago (CL); Jaime Hernan Carreno Valdés, III Region (CL); Fernando Arturo Geister Bühlmann, Buin-Region Metropolitana (CL)

(73) Assignees: DBT GmbH (DE); Codelco (DE)

( * ) Notice: Subject to any disclaimer, the term of this patent is extended or adjusted under 35 U.S.C. 154(b) by 0 days.

(21) Appl. No.: 10/561,674

(22) PCT Filed: Jun. 18, 2004

(86) PCT No.: PCT/EP2004/006637

§ 371 (c)(1),
(2), (4) Date: Apr. 20, 2006

(87) PCT Pub. No.: WO2005/001245

PCT Pub. Date: Jan. 6, 2005

(65) Prior Publication Data

US 2006/0208555 A1 Sep. 21, 2006

(30) Foreign Application Priority Data

Jun. 23, 2003 (DE) ..... 103 28 287
Nov. 14, 2003 (DE) ..... 103 53 352

(51) Int. Cl.
*E21C 41/22* (2006.01)

(52) U.S. Cl. ..... 299/18; 299/19

(58) Field of Classification Search ..... 299/18, 299/19

See application file for complete search history.

(56) References Cited

U.S. PATENT DOCUMENTS 968,100 A 8/1910 Washburne
(Continued)

FOREIGN PATENT DOCUMENTS

DE 402 498 C 9/1924
(Continued)

OTHER PUBLICATIONS

International Search Report, PCT/EP2004/006637, Dec. 7, 2004.

*Primary Examiner*—John Kreck
(74) *Attorney, Agent, or Firm*—Fay Sharpe LLP

(57) ABSTRACT

In the method according to the invention and the arrangement or according to the invention for extracting extraction products in underground mining operations using the caving method, the extraction products (20) collapsing in an upper gate area (10) are extracted via at least one extraction funnel (13) or the like into an extraction path (14) driven below the gate and are transported away therein by means of an extraction conveyor (15). According to the invention the extraction funnels (13) are arranged laterally beside the extraction conveyor (15) and lead at their lower end into a ramp surface (17) inclined towards the extraction conveyor, the extraction products extracted from the gate through the extraction funnels being transported slidingly over the inclined ramp surface to the extraction conveyor. The inclined ramp surface is preferably formed by a loading ramp (22) which is so arranged in an extraction chamber (16) branching off laterally from the extraction path that its one end (19), disposed higher, is located below the extraction funnel and its other end (23), disposed lower, forms an outlet (21) towards the extraction conveyor.

54 Claims, 14 Drawing Sheets

U.S. PATENT DOCUMENTS

| | | | | |
|---|---|---|---|---|
| 1,720,677 | A * | 7/1929 | Howlett | 193/3 |
| 2,298,599 | A | 10/1942 | Smith | |
| 4,377,310 | A | 3/1983 | Gubin et al. | |
| 5,104,239 | A | 4/1992 | Sague | |
| 5,112,474 | A * | 5/1992 | Douglas | 209/240 |

FOREIGN PATENT DOCUMENTS

| | | | |
|---|---|---|---|
| DE | 699 391 | C | 11/1940 |
| DE | 871 359 | C | 3/1953 |
| DE | 10 86 524 | B | 8/1960 |
| DE | 1141 163 | B | 12/1962 |
| DE | 12 15 484 | B | 4/1966 |
| DE | 12 48 255 | B | 8/1967 |
| DE | 32 45 339 | A | 6/1984 |
| DE | 42 36 832 | A | 5/1994 |

* cited by examiner

METHOD AND DEVICE FOR EXTRACTING EXTRACTION PRODUCTS IN UNDERGROUND MINING

CROSS-REFERENCE TO RELATED APPLICATIONS

This application is a national stage entry of international application number PCT/EP2004/006637, having international filing date Jun. 18, 2004, which was not published in English, which claims priority to German patent application number DE10328287.4, filed Jun. 23, 2003 and German patent application number DE10353352.4, filed Nov. 14, 2003, the entireties of which are incorporated by reference.

FIELD OF THE INVENTION

The invention relates to a method for extracting extraction products in underground mining operations using the caving method, whereby extraction products collapsing in an upper gate area are extracted via at least one extraction funnel or the like in the bottom rock into an extraction path driven below the gate, and are transported away in said extraction path by means of an extraction conveyor. The invention is further directed at an arrangement for extracting extraction products in underground mining operations using the caving method, the extraction product, after collapsing in a working gate area, being extractable via at least one extraction funnel or the like arranged in the bottom rock of the working gate and open to an extraction path driven below the gate, and being transportable away by means of an extraction conveyor arranged in the extraction path. Finally, the invention also relates to a loading ramp, as can be used in a preferred manner with the method and arrangement according to the invention.

BACKGROUND

DE 100 46 497 A1 has proposed a method for extracting extraction products, in particularly ores, e.g. copper ore, in which, after a working device has advanced, ore or the like collapsing or intentionally broken from the roof of an extraction gate is discharged through extraction funnels, chute holes or the like arranged in the floor of the gate into extraction paths driven below the gate, in which the won material reaching the extraction path through the extraction funnels, chute holes or the like is transported away by means of conveying devices.

The known method and arrangement are usable provided the extraction product breaking from the roof of the extraction gate has a comparatively small and not highly variable grain size which allows downward discharge into the extraction paths even through chute holes or extraction funnels having a comparatively small cross-section. The known method and the known arrangement are limited to the extraction of products of small grain size, since a too-large cross-section of the extraction funnels or chute holes arranged above the extraction conveyor would lead to an unduly large quantity of material reaching the extraction conveyor, which could not be reliably transported away. In that case the conveyor can be quickly encumbered by extraction product to be transported away. A further disadvantage of the known method is the high rate of wear to which the extraction conveyors are exposed even when extracting fine-grained material, since the latter falls freely in a substantially unbraked manner through the extraction funnels into the extraction path, for the most part directly on to the conveying element of the extraction conveyor.

It is the object of the invention to improve the known method and the known arrangement that even won material having large grain size which collapses in the gate area can be extracted and transported away via extraction paths located below said gate.

SUMMARY

This object is achieved with the method according to the invention in that the at least one extraction funnel is arranged laterally beside the extraction conveyor and leads at its lower end into a ramp surface inclined towards the extraction conveyor, and in that the extraction products are transported via the inclined ramp surface to the extraction conveyor.

Through the arrangement of the extraction funnel or funnels laterally beside the extraction conveyor, and the redirection of the throat cross-section of the funnel or funnels on to the inclined ramp surface it is achieved, firstly, that the won material reaching the extraction path from the gate through the extraction funnel or funnels is considerably braked before being transferred to the extraction conveyor, and therefore no longer reaches the conveying element practically in free fall. In addition, the laterally offset arrangement of the extraction funnel or funnels makes it possible to dimension its or their cross-section considerably larger than with the method known hitherto, and therefore to extract larger fragments without the extraction funnel being blocked thereby. The inclined ramp surface also leads to self-regulation of the quantity of won material reaching the extraction path through the extraction funnel, since only a limited quantity of material per unit time can slide over the oblique ramp surface and reach the extraction conveyor. In this connection it is especially advantageous if the outlet of the inclined ramp surface facing towards the extraction conveyor is blocked by means of a blocking element when the degree of charging of the extraction conveyor exceeds a predefined value. It may be advantageous for the reliable removal of the extracted ore if the extraction product reaching the extraction conveyor via the ramp surface, or at any rate the parts of the extracted product which are so large that they cannot be transported by the conveyor, or can be transported in only a restricted manner, are reduced in size before or during their transfer to the extraction conveyor. Furthermore, it may be advantageous if the extraction products located in the outlet of the ramp surface are transported towards the extraction conveyor by means of an activatable conveying device, so that the transfer of the extracted materials to the extraction conveyor is ensured in all cases.

In conformity with the method according to the invention, the arrangement according to the invention is characterised by a loading ramp having a ramp surface aligned substantially transversely to the conveying direction of the extraction conveyor and inclined towards same, one end of which ramp surface, disposed higher, is located below the extraction funnel and the other end, disposed lower, forms an outlet to the extraction conveyor. To be able to install the loading ramp in the intended position below the extraction funnel in an especially simple manner, and to make possible regular maintenance and repair operations, it is especially advantageous if an auxiliary path disposed substantially parallel to the extraction path is provided, through which the loading ramp is accessible from the rear.

The loading ramp advantageously includes a loading ramp frame arranged in the region below the extraction funnel, and a base plate arranged on the floor. In this case the base plate may be braceable against the rock by means of one, preferably two props.

In a preferred embodiment of the invention, the inclination of the ramp surface varies over its length, the ramp surface then advantageously having a greater inclination below the extraction funnel than in the outlet region to the extraction conveyor. The ore material discharged through the extraction funnel is decelerated by the decreasing inclination of the ramp surface while passing over it, so that it impinges on the extraction conveyor at only low velocity.

It is also especially advantageous if the inclination and/or height of the ramp surface, or the impact plate forming same or the loading ramp frame, is adjustable. The arrangement may be so designed that the ramp surface or the impact plate forming same is pivoted at its rear end facing towards the auxiliary path. In addition, it is advantageously possible that the ramp surface or the impact plate forming same is fixable at different heights on the loading ramp frame, at its front end facing towards the extraction path, by means of a plug-in connection. This makes it possible to adapt the loading ramp optimally to different underground situations, or to different extraction conveyors or other peripheral units. In addition, this configuration facilitates repair work on the loading frame, or in some cases makes such repair work possible at all.

In an especially advantageous development of the invention, the loading ramp is provided with a blocking device. The latter may be arranged in or upstream of the outlet region. In a preferred embodiment the blocking device may consist substantially of at least one pivoted blocking flap which, depending on its position in the outlet region of the loading ramp, increases or decreases the passage cross-section for the won extraction product. As the forces exerted by the extraction product on the blocking flap may be considerable, it is useful if the swivel drive of the blocking flap consists substantially of at least one hydraulic cylinder.

The blocking flap may be swivellable about a substantially horizontal axis and may preferably be formed by a section of the ramp surface in its outlet region. In this embodiment, therefore, the inclination of the ramp surface is varied in the outlet region, if necessary to the extent that the inclination of the ramp surface is adjusted to zero or even to a negative inclination, so that the loading ramp no longer forms a continuously inclined slide surface to the conveyor but an approximately V-shaped trough in cross-section, in which the rock emerging from the extraction funnel is caught at least intermittently.

An alternative, advantageous embodiment is provided if the blocking flap is formed substantially by a closure composed of segments or sectors, which forms a preferably curved dam wall separating the feed zone of the ramp surface from the outlet region if required, which closure can be swivelled up and down about the horizontal axis by means of at least one swivel arm. In this case, therefore, the blocking flap acts in a very similar manner to a water barrage. The preferably curved dam wall has the particular advantage that the closure composed of segments or sectors can also be moved to its blocking closed position if the dam wall is charged with rocks or the like.

Another embodiment is also possible in which the blocking flap is swivellable about a substantially vertical axis and is formed by at least one, preferably two, flap(s) swivellable above the outlet region of the ramp surface in the manner of a gate. By swivelling the gate flap(s) the passage cross-section between the free sides of the gate and, if applicable, a side barrier of the ramp surface, can be adjusted very sensitively. A further alternative is provided if the blocking flap is formed by at least one swivellable gate extending downwardly from the roof of the extraction path or from a support frame and pivoted at its upper end about an approximately horizontal pivot axis disposed substantially parallel to the extraction conveyor.

In a further, alternative configuration of the blocking device, the latter may consist substantially of a sectional gate comprising a plurality of blocking segments articulated together and running in lateral guide rails. Similarly, it is possible for the blocking device to consist substantially of a roll-up gate comprising a plurality of articulated blocking segments that can the rolled up on a horizontal shaft arranged above the ramp surface. In both these embodiments, or in general, it is also possible for the blocking device to include or be formed by at least one swing flap suspended about a horizontal axis. In this case it is especially advantageous if a plurality of swing flaps are articulated together to form a swing flap curtain which constitutes the blocking device.

The loading ramp may include or form in the outlet region a conveying device which conveys in the direction of the extraction conveyor, with which conveying device parts of the extraction product which do not reach the conveyor automatically as a result of the inclination of the ramp surface can be fed thereto. The conveying device may be, for example a vibrating trough or an oscillating conveyor. It is especially advantageous if the conveying device includes or consists substantially of a thrust blade. This thrust blade may preferably be arranged on an inclined upper face of a wedge loader that is insertable in or below the won material at the front end of the loading ramp or its frame on the extraction path side. In this case the arrangement is advantageously such that the wedge loader can be advanced in the direction of the extraction path by means of thrust cylinders. These thrust cylinders may bear against the base plate of the loading ramp or its frame; in many cases it is still more advantageous if the thrust cylinders bear against an expanding frame including expansion cylinders that is braceable between the floor and the roof.

The thrust blade is preferably driveable by at least one clearing cylinder which may be arranged, for example, substantially parallel to the inclined upper surface of the wedge loader below a fixed cover plate, and bears at one end against a fixed bearing on the wedge loader and at the other end against a clearing beam that is displaceable by means of the clearing cylinder over a part of the upper surface of the wedge loader. In this case the clearing beam is preferably arranged at the front end of a thrust plate resting on the cover plate and displaceable over same.

In a further embodiment of the invention the conveying device is arranged on the loading ramp frame at least partially below the ramp surface and the front end of the conveying device facing towards the extraction conveyor projects from the latter in its operating state. The conveying device may be able to be advanced as a compact unit from the rear end of the loading ramp frame to its front end in the direction of the extraction conveyor. In particular, it is possible that the conveying device can be installed in the front, outlet region of the loading frame from the rear, through and below the loading ramp frame. This configuration also makes possible, in particular, simple replacement of the conveying device, for example, if it is damaged or worn. The worn or damaged equipment can then be transported away especially advantageously by means of the extraction conveyor, the conveying device being advanced up to the extraction conveyor with the aid of thrust cylinders bearing against the base plate of the loading frame or against an expanding frame and, after the cylinders and any other connections to the loading ramp have been uncoupled, being transferred to the conveyor in order to be transported away. The "new" conveying device is then transported to its working position through the auxiliary path from the rear of the loading ramp.

To prevent excessively large pieces of the extraction product from reaching the conveyor it is especially advantageous if a size reduction device for extraction products, which may comprise substantially a crusher, in particular an impact roll or jaw crusher, is associated with the loading ramp. However, it has been found to be especially advantageous if the size reduction device comprises essentially a chisel hammer or drill hammer active in the outlet region of the loading ramp and arranged above the ramp surface, with which device especially large pieces of won material can be reduced in size in a targeted manner. The chisel and/or drill hammer is preferably suspended from the roof of the extraction path or from a rail track arranged thereon and is displaceable in the longitudinal direction of the extraction conveyor at least over the width of the loading ramp.

A further preferred embodiment of the invention is provided if a lattice sieve, which may be arranged, for example, above the vibrating trough, is associated with the loading ramp. By means of such a vibrating sieve, also known as a "grizzly", it is possible to grade the extraction product before transferring it to the conveying device, and initially to hold back large pieces of won material in order to reduce their size before transferring them to the conveyor, while smaller lumps of extraction product pass through the sieve meshes unhindered. In this case it is especially advantageous if the lattice sieve is coupled to the vibrating trough, whereby the grading process is assisted and size reduction of friable material is even effected by the sieve alone.

It has proved advantageous if the lattice sieve has a surface the inclination of which is variable relative to the loading ramp, it being possible so to design the arrangement that the lattice sieve includes two sieve screen sections which are articulated together and can be erected above the loading ramp in the manner of a roof. The adjustable inclination of the sieve screen produces different sieving results which are adjustable to different requirements. In addition, through the erecting of its screen or screen sections, the lattice sieve can serve as a blocking element for at least the larger pieces of won material conducted from the extraction funnel and may therefore, in some circumstances, completely replace or make superfluous an additional blocking device.

The extraction conveyor may be arranged below the outlet region of the loading ramp, facilitating the transfer of material. The loading ramp is preferably provided at the free end of its outlet region with a loading flap extending over a side wall of the extraction conveyor, so that, in being transferred to the conveyor, the won product does not fall between the latter and the loading ramp.

The extraction conveyor may be a drag link conveyor or preferably a vibrating trough conveyor, as commonly used in underground mining.

The invention provides a loading ramp for extracting extraction products in underground mining operations using the caving method, in particular for use with the method and in the arrangement according to the invention, comprising a loading ramp frame having on its upper face a ramp surface inclined downwardly from a feed zone to an outlet region with a loading flap at its end, a blocking device including at least one adjustable blocking element being provided in the outlet region, by adjusting which the passage cross-section above the ramp surface towards the loading flap is variable. The inclination of the ramp surface may preferably be varied over its length, in which case the ramp surface preferably has a greater inclination below the extraction funnel than in the outlet region. A pivoted blocking flap may preferably be used as the blocking element.

The blocking flap of this loading ramp may be swivellable about a substantially horizontal axis and may be formed by a section of the ramp surface in its outlet region. A likewise very advantageous embodiment is provided if the blocking flap is formed substantially by a closure composed of segments or sectors, which closure includes a preferably curved dam wall separating the feed zone of the ramp surface from the outlet region if required and being swivellable up and down about the horizontal axis via at least one swivel arm.

It is also possible for the blocking flap to be swivellable about a substantially vertical axis and to be formed by at least one, preferably two, flap(s) swivellable in the manner of a gate above the outlet region of the ramp surface. The loading ramp may include or form in its outlet region a driven vibrating trough, and it is possible for the inclination of the surface of the loading ramp to be variable at least in the outlet region.

Finally, it is advantageous if a lattice sieve is associated with the loading ramp. Said sieve may be arranged above the vibrating trough and in an especially advantageous embodiment of the invention is coupled to the vibrating trough.

The lattice sieve may include a sieve screen the inclination of which is variable relative to the loading ramp; preferably it includes two screen sections articulated together that can be erected above the loading ramp in the manner of a roof.

BRIEF DESCRIPTION OF THE DRAWINGS

Further features and advantages of the invention will be apparent from the following description in which preferred embodiments of the invention are explained in more detail with reference to examples and to the drawings, in which.

DETAILED DESCRIPTION

Figure 1:
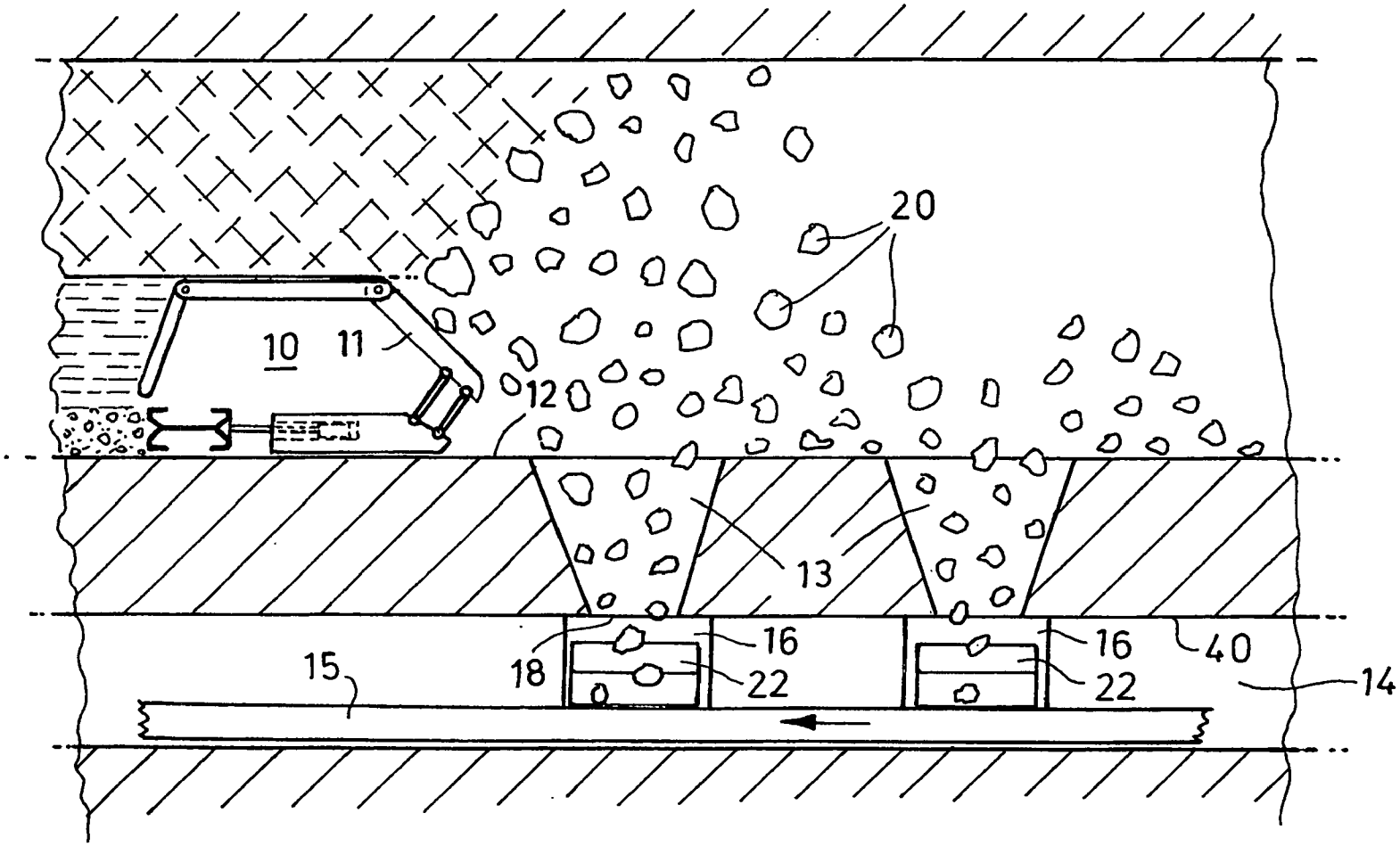
FIG. 1 shows an underground mining operation for the extraction of copper ore in section.

FIG. 1 shows an underground mining extraction operation for extracting copper ore which is present with a large thickness of approximately 50 meters. The first extraction step takes place in a manner known per se by working the gate with a stope support 11 advancing along a working gate 10 and an associated extraction and loading device, which equipment is not represented in detail here and will not the described individually. The extraction device may be of the type described, for example, in DE 100 46 497 A1, to which reference is made here.

Only the lower part of the full thickness of the copper ore is worked with the gate face; by far the larger portion of the copper ore present, which forms the roof as the working gate advances, collapses after the stope support has passed through and is discharged downwards for extraction through extraction funnels 13 arranged in the floor 12 of the working gate 10, to be transported away by means of extraction conveyors 15 via extraction paths 14 driven at a vertical distance of approximately six meters below the working gate.

Figure 2:
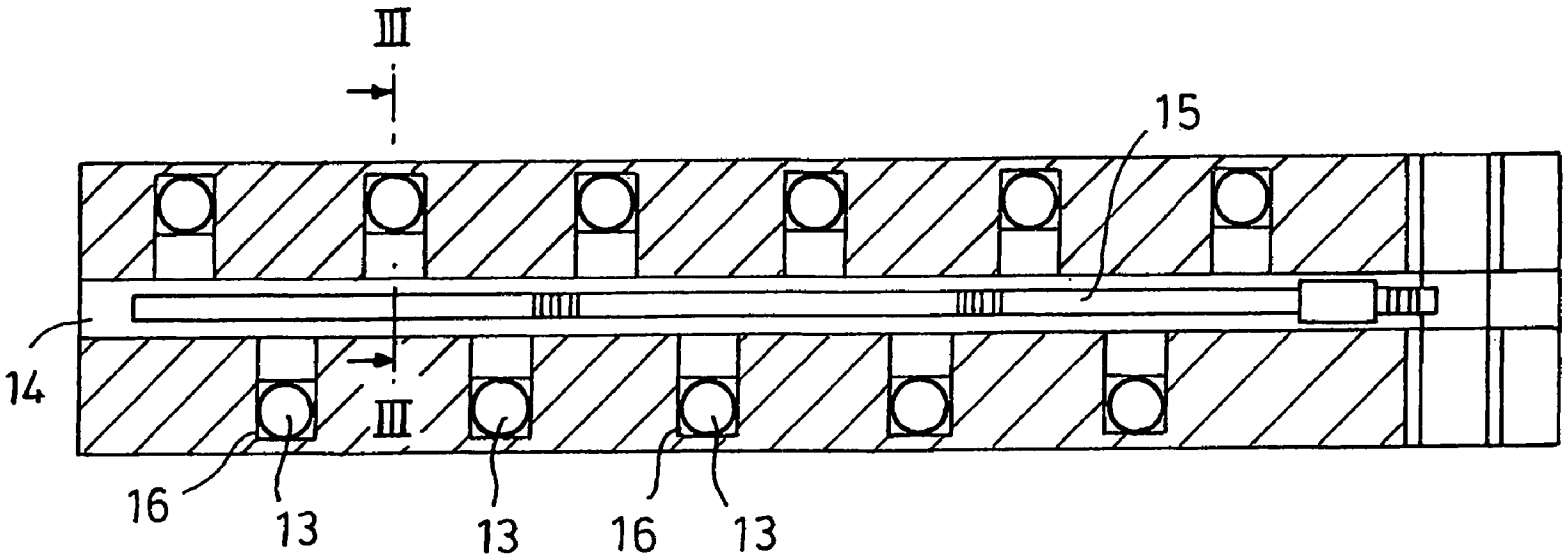
FIG. 2 shows an extraction path in the mining operation according to FIG. 1 in a section along the line II-II.

In FIG. 2 the extraction path 14 shown in longitudinal section in FIG. 1 is represented in a top view on a smaller scale. It can be seen that the extraction funnels are arranged laterally beside the extraction conveyor 15, at a distance of preferably approximately four to eight meters from the conveyor running in the extraction path. Over the full length of the extraction path or of the conveyor arranged therein a plurality of extraction funnels are provided on each side, the arrangement being such that the left-hand and right-hand extraction funnels are offset with respect to one another in the longitudinal direction of the path.

Figure 3:
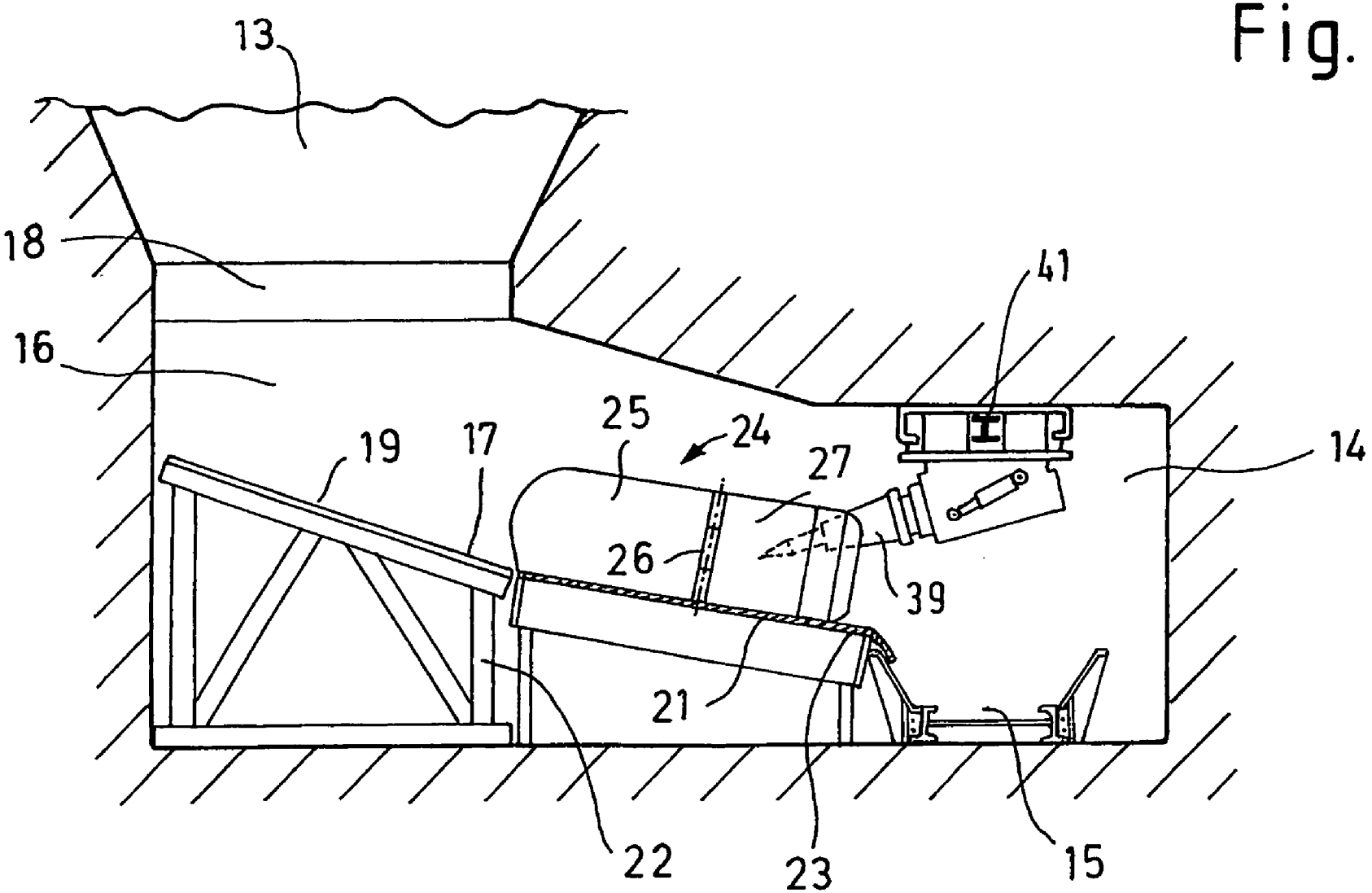
FIG. 3 shows a first embodiment of the inventive arrangement for carrying out the inventive method in a section along the line III-III in FIG. 2.
Figure 4:
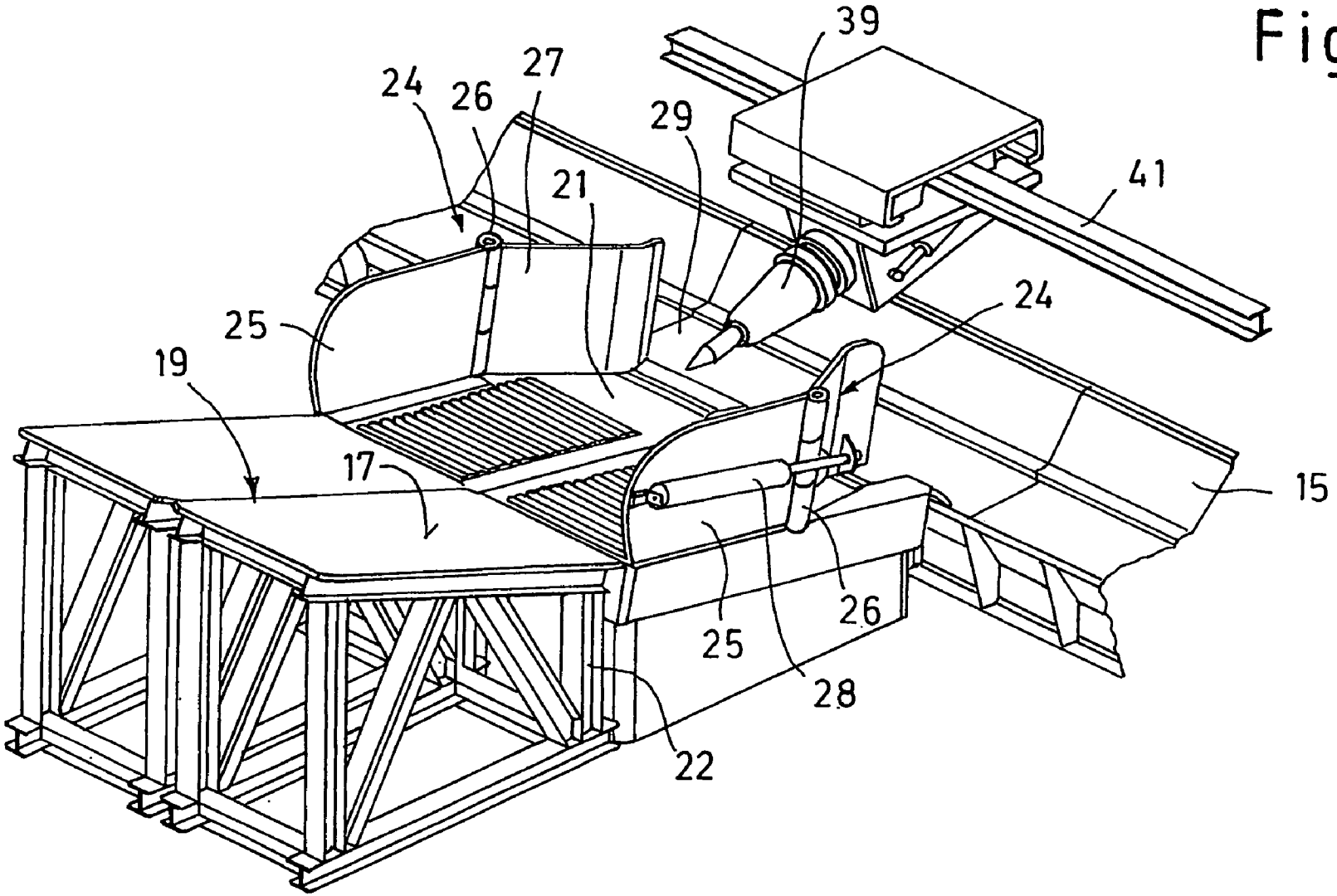
FIG. 4 shows the subject of FIG. 3 in a perspective representation, the rock surrounding the arrangement being omitted.

Referring also to FIG. 3, extraction chambers 16, in which inclined ramp surfaces 17 are located, are driven to the extraction funnels located at a lateral distance from the extraction path or the conveyor arranged therein. The lower ends 18 of the extraction funnels 13 lead into the ramp surfaces 17, the lower end 18 of the extraction funnels 13 opening above a feed zone 19 of the ramp surface. The won material 20 (FIG. 1) passing through the extraction funnels 13 can slide laterally into the extraction path 14 via the inclined ramp surfaces in the extraction chambers and be transferred to the extraction conveyor 15 via an outlet 21 of the ramp surface (FIG. 3).

As is apparent from FIGS. 3 to 8, the inclined ramp surface 17 in each extraction chamber 16 is a component of a loading ramp 22 formed by a steel structure, the upper face of which it forms. The loading ramp is installed in its extraction chamber 16 in such a way that the end of the ramp surface disposed higher, with the feed zone 19, is located below the extraction funnel 13, while its other end 23, disposed lower, forms the outlet 21 towards the extraction conveyor 15. As can be clearly seen in FIG. 3, the inclination of the ramp surface 17 may vary over its length, having a greater inclination below the extraction funnel 13 than in the outlet region 21 leading to the extraction conveyor 15. In the outlet region 21 the loading ramp 22 is provided with a blocking device 24, which in the first embodiment, shown in FIGS. 3 and 4, consists substantially of two guide plates 25 laterally delimiting the ramp surfaces in their outlet region and gate flaps 27 articulated to the guide plates 25 about vertical axes 26. The gate flaps 27 can be swivelled inwardly towards one another about the vertical axes 26 by means of hydraulic cylinders 28 engaging at one end with the guide plates and at the other end with the gate flaps, and thereby can restrict or, if required, completely close the passage cross-section 29 to the extracted extraction product 20 in the outlet region 21.

Figure 5:
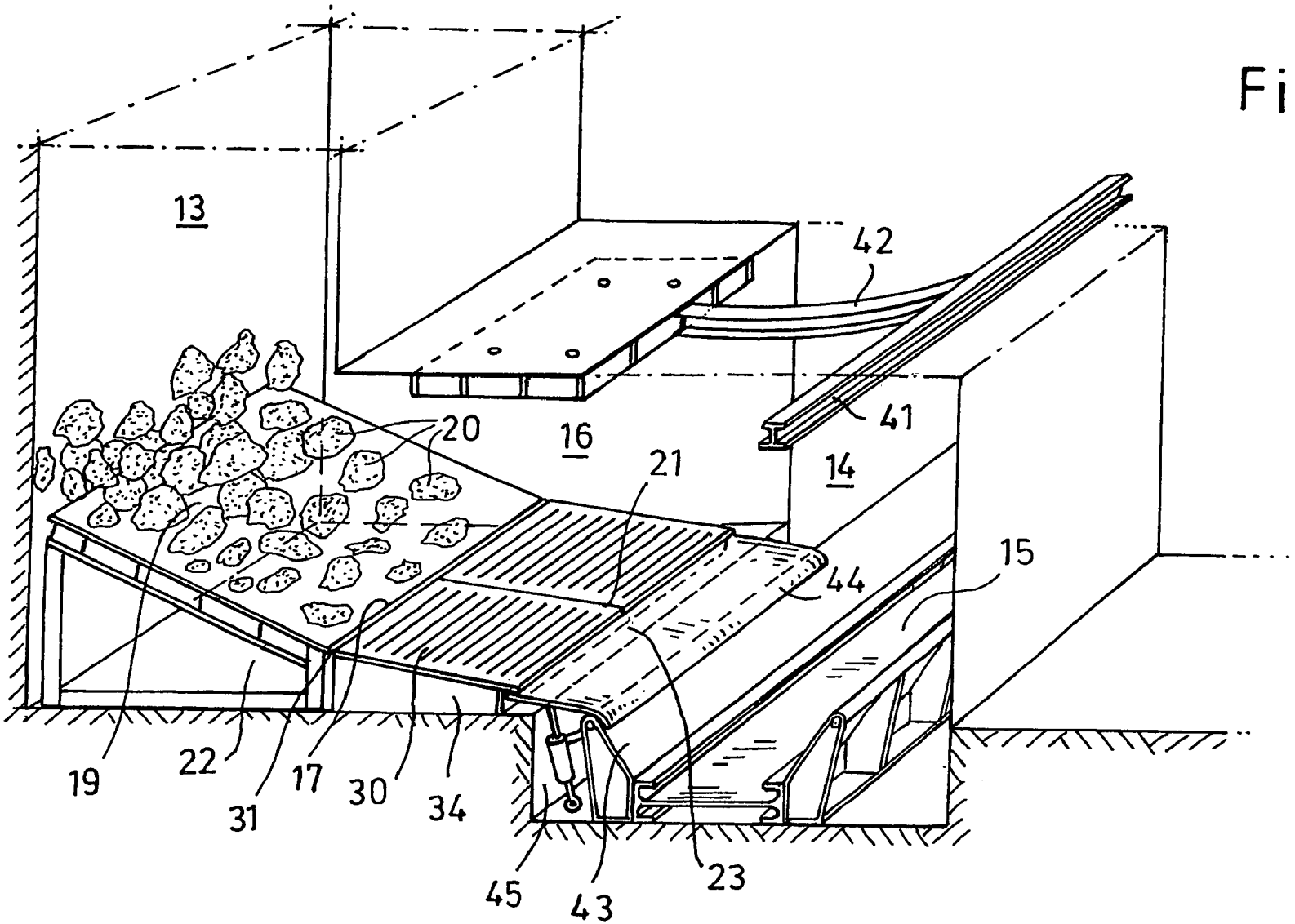
FIG. 5 shows a second embodiment of the inventive arrangement for carrying out the inventive method in a perspective representation.
Figure 6:
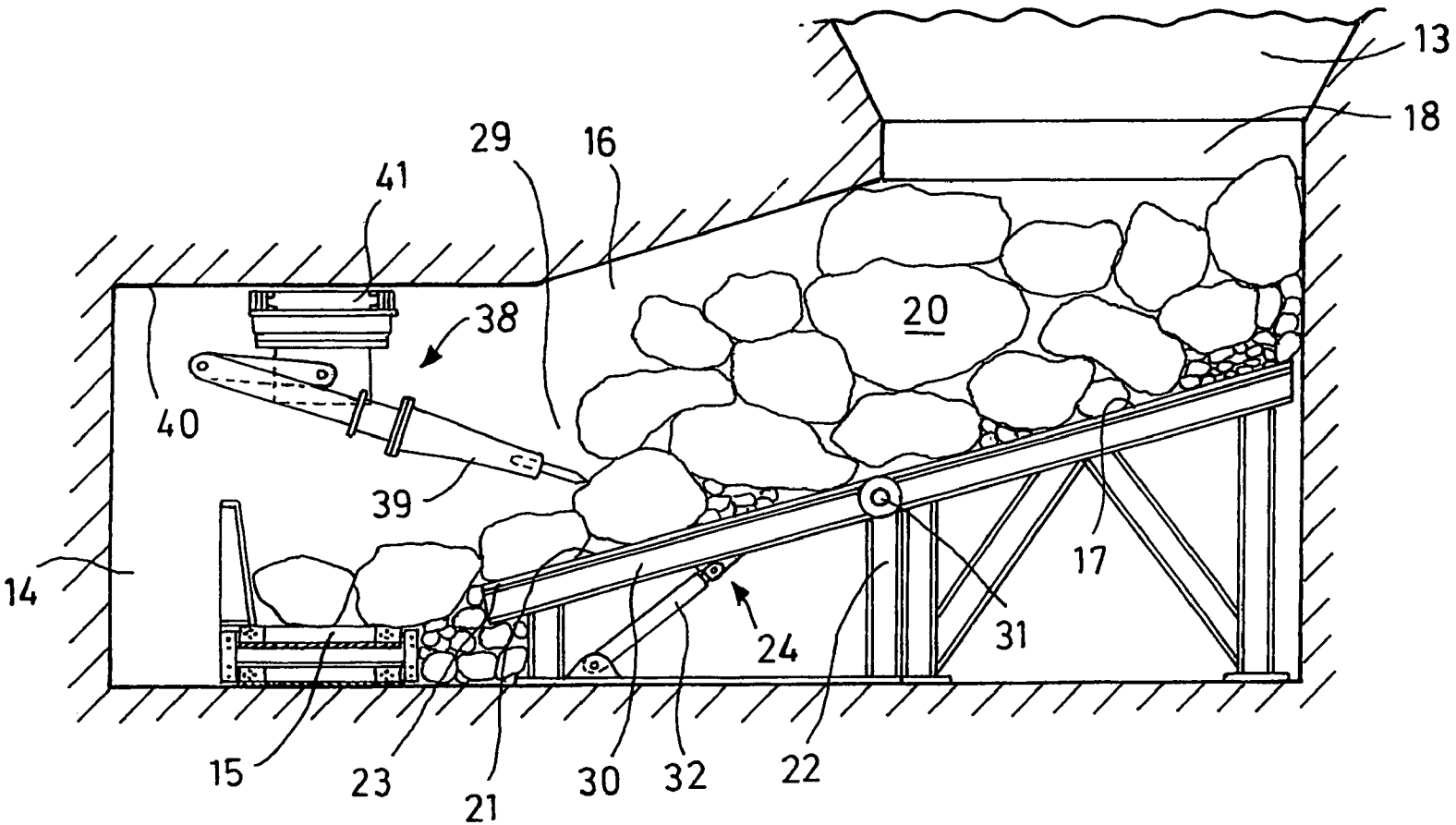
FIG. 6 shows the subject of FIG. 5 in a first working position of the loading ramp in a side view.
Figure 7:
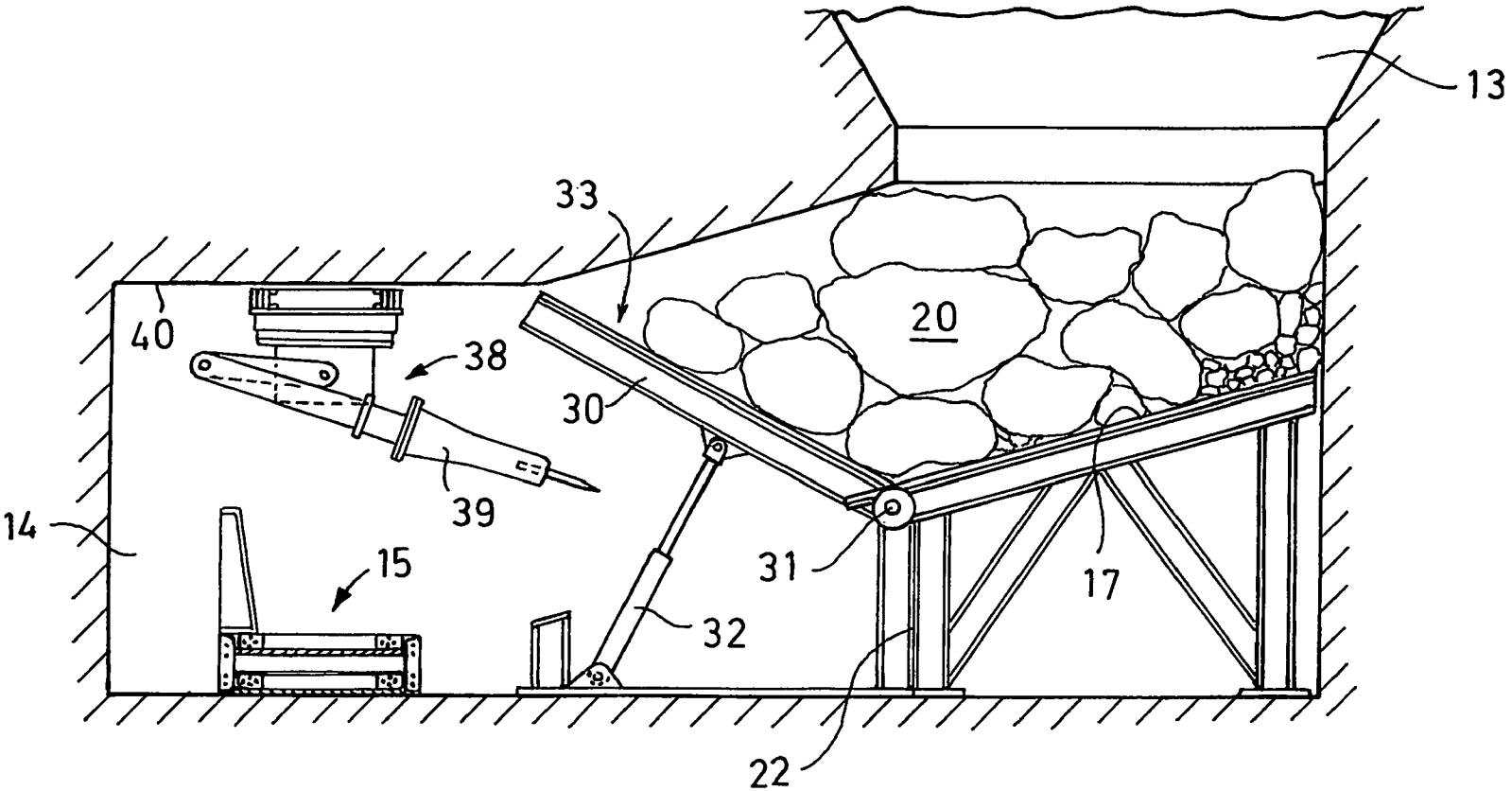
FIG. 7 shows the subject of FIG. 6 in a second working position of the loading ramp in a side view.

In the second embodiment of the arrangement according to the invention, represented in FIGS. 5-7, the blocking device 24 is formed by the front section 30 of the ramp surface in its outlet region 21, which for this purpose is swivellable about a horizontal axis 31 and can be moved by means of two hydraulic jacks 32 from the completely lowered position shown in FIG. 6 to the raised position shown in FIG. 7, in which the loading ramp forms in section an approximately V-shaped collecting trough 33 for the won material. In this embodiment the front section 30, that is swivellable about the axis 31 by the hydraulic jacks 32, is in the form of a driven vibrating trough 34, i.e. an oscillating motion directed transversely to the longitudinal direction of the extraction path can be imparted thereto, which motion assists the transportation of the won material 20 on to the extraction conveyor, given an only slightly lowered position of the front section 30 with respect to the horizontal axis 31.

Figure 8:
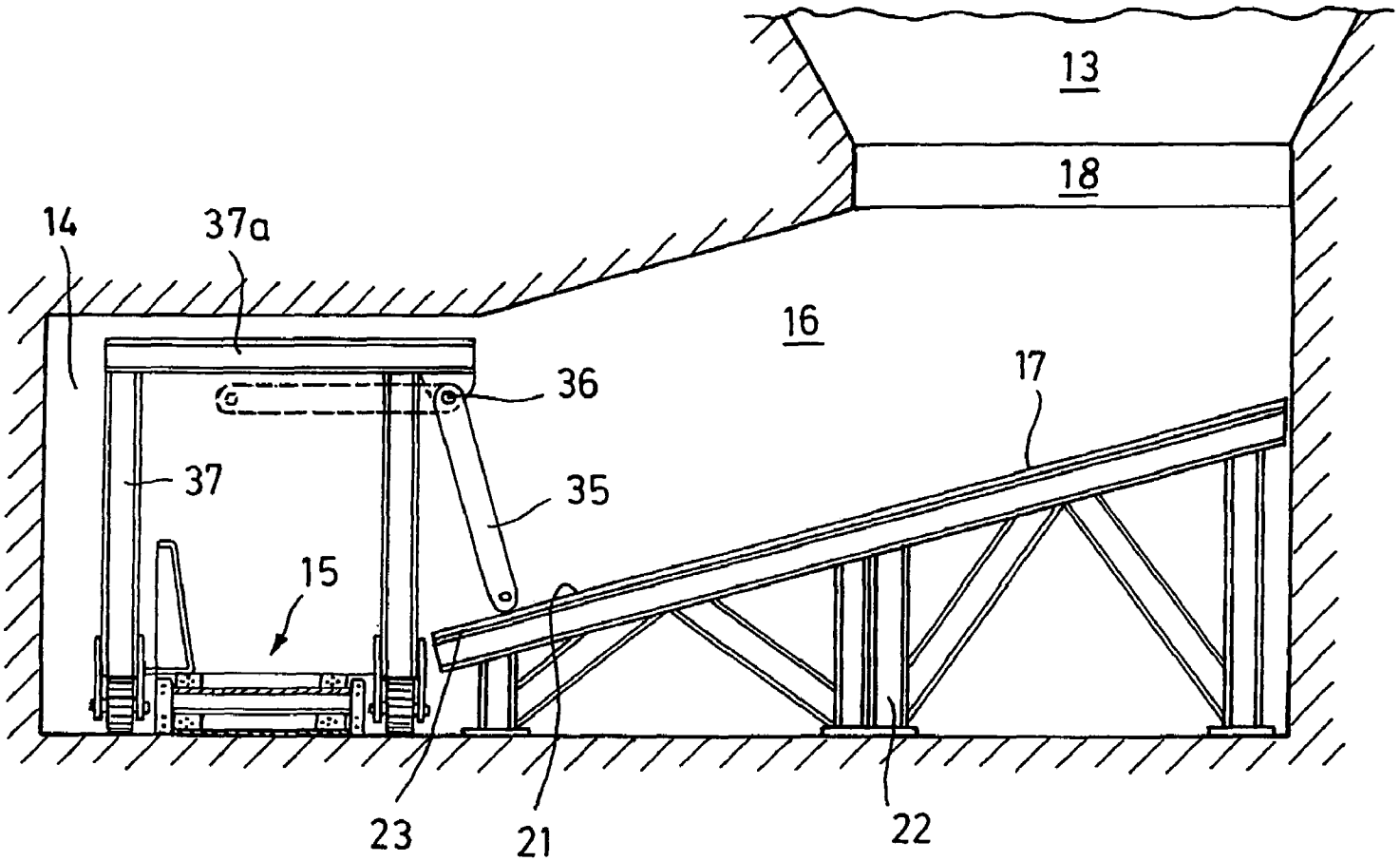
FIG. 8 shows a third embodiment of the inventive arrangement for carrying out the inventive method in a representation corresponding to FIG. 7.

In the third embodiment of the arrangement according to the invention, represented in FIG. 8, the blocking device is formed by a swivelling gate 35 that is swivellable at its upper end about a horizontal pivot axis 36 disposed substantially parallel to the extraction conveyor 15, which axis 36 is located on a support frame 37 arranged in the extraction path 14. To fully open the passage cross-section 29 the swivelling gate can be swivelled to an upper position, represented by a broken line in FIG. 8, by means of a hydraulic drive (not shown), in which upper position it rests substantially against the upper cross-beam 37*a* of the support frame. To close the passage cross-section 29 substantially completely, the swivelling gate is moved to its lowered position, represented by a continuous line in FIG. 8, in which its lower end is positioned directly above the ramp surface 17.

Figure 9:
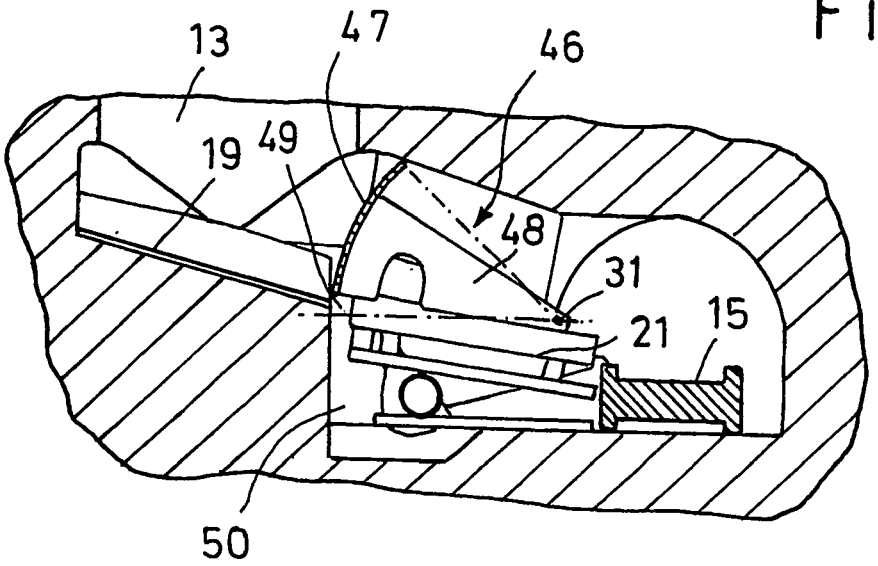
FIG. 9 shows a fourth embodiment of the inventive arrangement for carrying out the inventive method in a representation corresponding to FIG. 3.

In the fourth embodiment, according to FIG. 9, a blocking flap is provided in the form of a segmental closure 46, which includes a dam wall 47 that is curved about the horizontal pivot axis 31. The dam wall is provided with two lateral swivel arms 48 which are journalled swivellably about the pivot axis 31. The arrangement is so configured that the dam wall 47 is located upstream of the pivot axis 31 in the extraction path of the won material from the feed zone 19 to the outlet region 21. To release the extraction flow, the blocking flap can be swivelled down, the dam wall 47 being lowered through a slot 49 arranged between feed zone 19 and outlet 21 into a cavity 50 provided below the ramp 17. To actuate the flap a hydraulic cylinder drive (not shown) is provided in this case also.

It can be seen from the drawing that the dam wall 47 can entirely close the part of the extraction chamber 16 above the ramp surface 17 up to the roof, while it opens the passage equally completely when the blocking flap is fully lowered.

Figure 10:
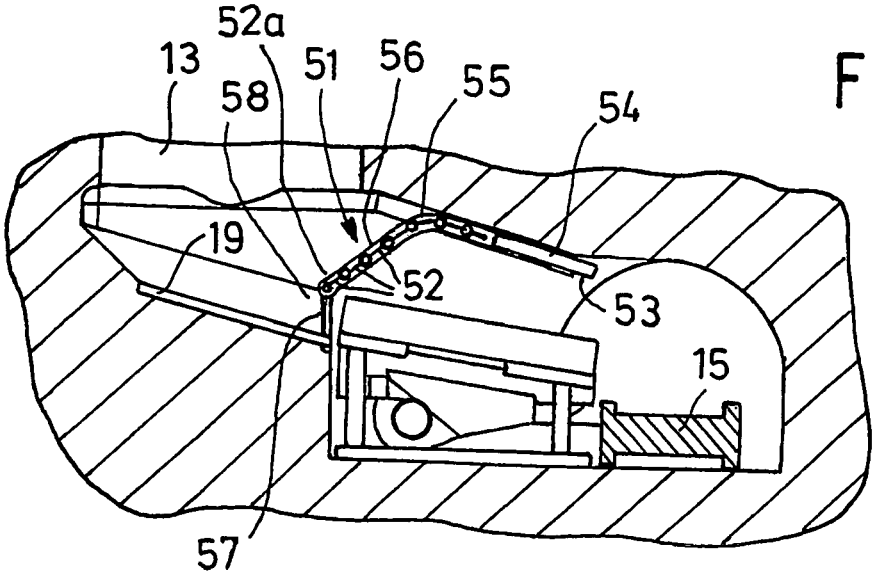
FIG. 10 shows a fifth embodiment of the inventive arrangement for carrying out the inventive method in a representation corresponding to FIG. 3.

In the embodiment of the invention shown in FIG. 10, the blocking device 24 consists substantially of a sectional gate 51 which comprises substantially a plurality of blocking segments 52 articulated together. As is known with sectional gates per se, the blocking segments 52 are provided at their ends with guide and support rollers which run in lateral guide rails 53. The guide rails 53 are nailed by a first partial section 54 to the roof of the extraction chamber 16 and then lead via a radiused portion 55 into a second inclined partial section 56 which ends a short distance above the ramp surface 17. Articulated to the lowest blocking segment 52*a* is a swing flap 57 which is not guided laterally in the guide rails 53 but hangs vertically downwards through its own weight and in the closed position of the sectional gate 51 closes the gap 58 remaining above the ramp surface 17 up to the start of the second partial section 56 of the guide rails 53.

Figure 11:
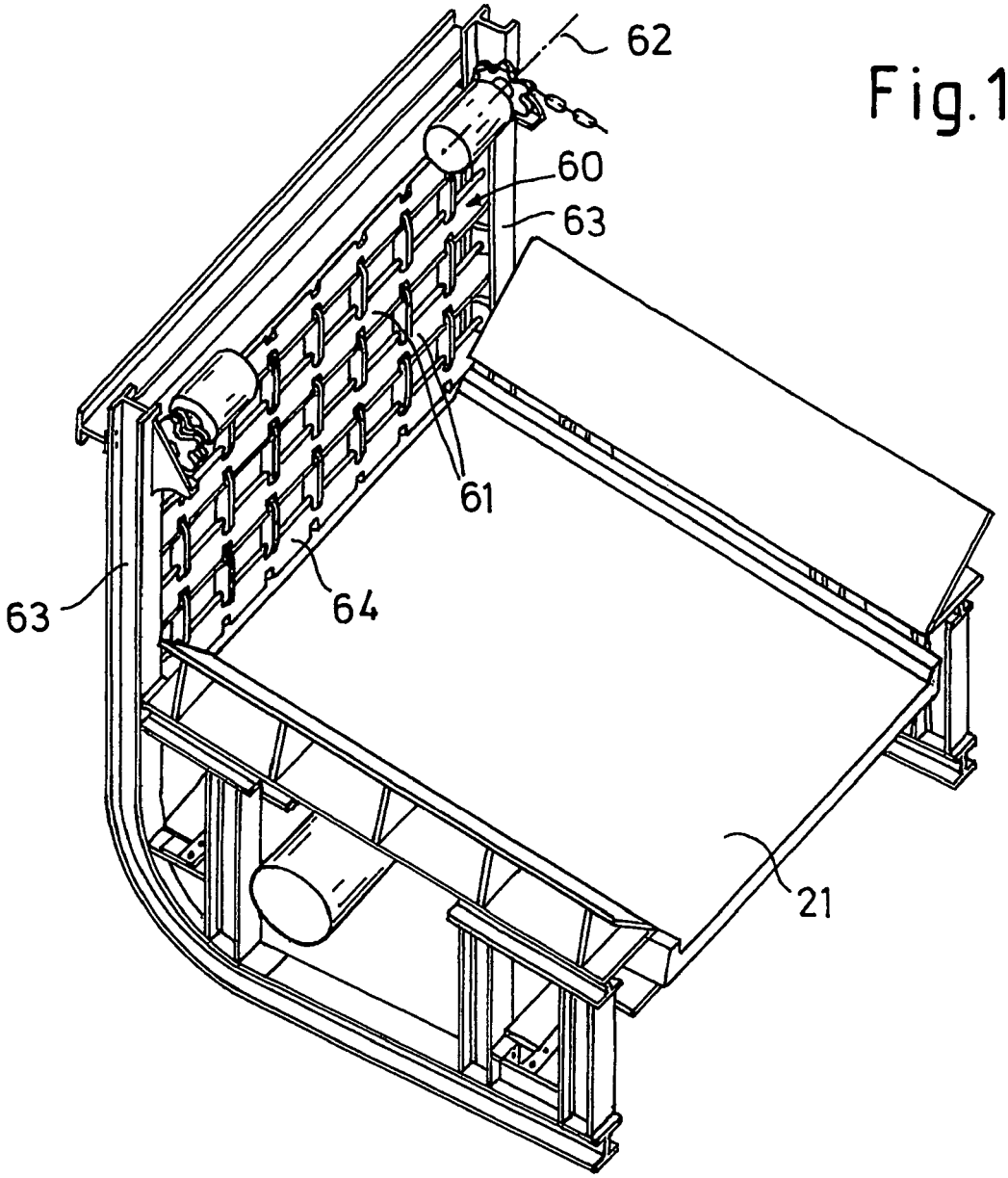
FIG. 11 shows a sixth embodiment of the inventive arrangement for carrying out the inventive method in a perspective representation.

The embodiment represented in FIG. 11 has a similar configuration. Instead of a segmental gate with lateral guides, the length of which is so dimensioned that all the blocking segments are guided one behind the other horizontally therein when the gate is fully open, here the blocking device 24 consists of a roll-up gate 60 comprising a plurality of blocking segments 61 that are articulated together and can be wound on to a horizontal shaft 62 arranged above the ramp surface 17 directly below the roof. In this case, too, lateral guide rails 63, in which the blocking segments 61 run as the roll-up gate is opened and closed, are provided over the actual opening travel or lifting height. Here, too, a lower swing flap 64 provides the lower closure to the ramp surface with the gate fully closed.

Figure 12:
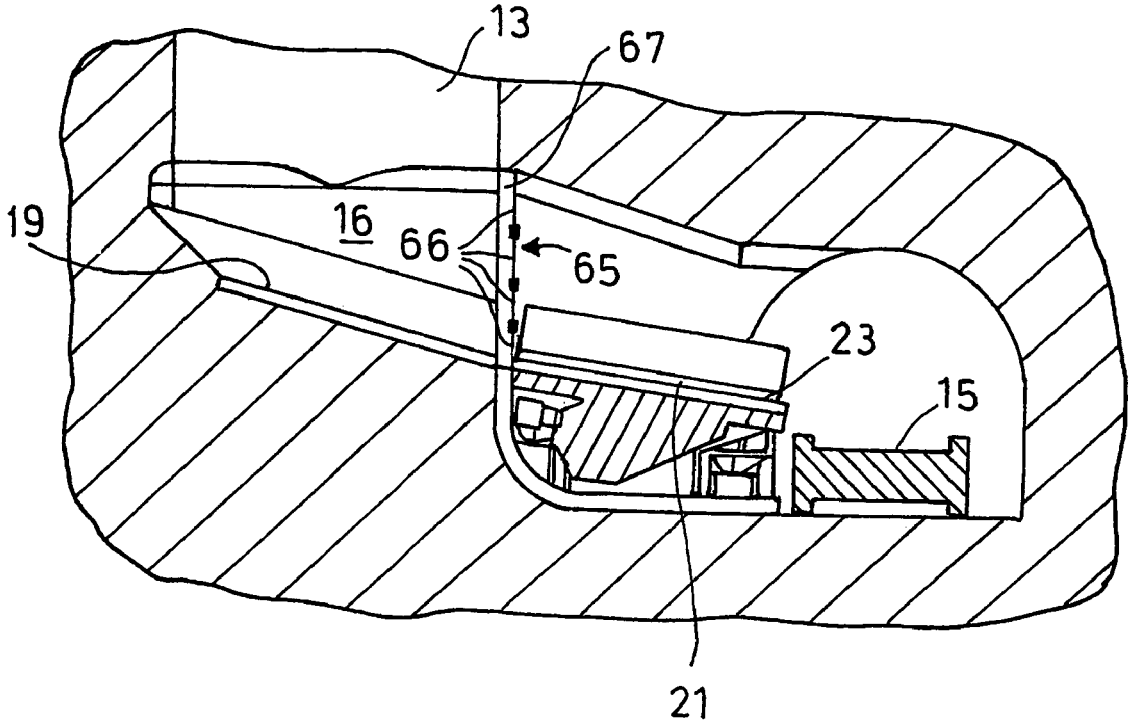
FIG. 12 shows a seventh embodiment of the inventive arrangement for carrying out the inventive method in a representation corresponding to FIG. 3.
Figure 13:
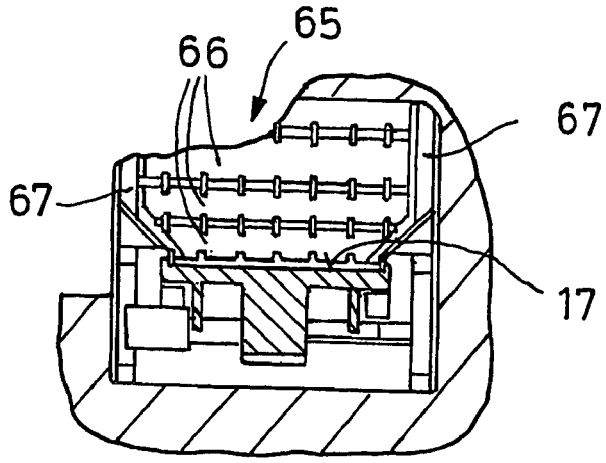
FIG. 13 shows the subject of FIG. 11 in a section along the line XII-XII.

In the embodiment represented in FIGS. 12 and 13 the blocking device 24 consists of a swing flap curtain 65 comprising a plurality of swing flap elements 66 articulated to one another, the upper swing flap element 66 being fixed to the roof. Because of its high dead weight, the swing flap curtain 65 closes the extraction chamber until the pressure of the rock accumulating against its reverse side 67 on the feed side is sufficiently large to push up the swing flap 66 in the direction of the outlet, thus opening a gap through which material can pass. The maximum height of the gap can be adjusted in that one or more of the swing flap elements 66, starting from the roof, are locked at the sides by means of locking pins or the like (not shown) to lateral locking rails 68.

With the aid of the various blocking devices it is possible to restrict or completely block the outlet 21 of the inclined ramp surface if the degree of charging of the extraction conveyor threatens to become too large. Overloading of the extraction conveyor can thereby be effectively avoided.

To reduce large pieces of won material which reach the surface of the loading ramp through the extraction funnel to a size suitable for the extraction conveyor before they are transferred to the latter, a size reduction device 38 (e.g., FIGS. 6 and 7) for such pieces of the extraction products is associated with the loading ramp of the arrangement according to the invention. In the first two embodiments of the inventive arrangement, the size reduction device 38 consists substantially of a hydraulic chisel hammer or drill hammer 39 (FIGS. 3 and 4) acting in the outlet region 21 of the loading ramp 22 and arranged above the ramp surface 17, which chisel hammer or drill hammer 39 is suspended from a rail track 41 arranged on the roof 40 of the extraction path 14 and is displaceable in the longitudinal direction of the extraction conveyor. In the embodiment represented in FIG. 5 the rail track 41 also has a branch 42 leading into the extraction chamber 16, so that the hydraulic drill hammer 39 can be moved close to the extraction funnel 13 and can already reduce the size of large fragments of won material falling through the funnel in the feed zone 19 of the ramp surface 17.

It can be seen from the drawings relating to the first and second embodiments that the extraction conveyor 15 may be arranged below the outlet region 21, in which case the loading ramp is usefully provided at the free end of its outlet region 21 with a loading flap 44 extending over a side wall 43 of the extraction conveyor 15, so that small-grain won material cannot fall into the gap 45 between conveyor and loading ramp. In the exemplary embodiments illustrated the extraction conveyor is in the form of a vibrating trough conveyor; however, it is equally possible to use a different type of conveyor, for example, a drag link conveyor.

Figure 14:
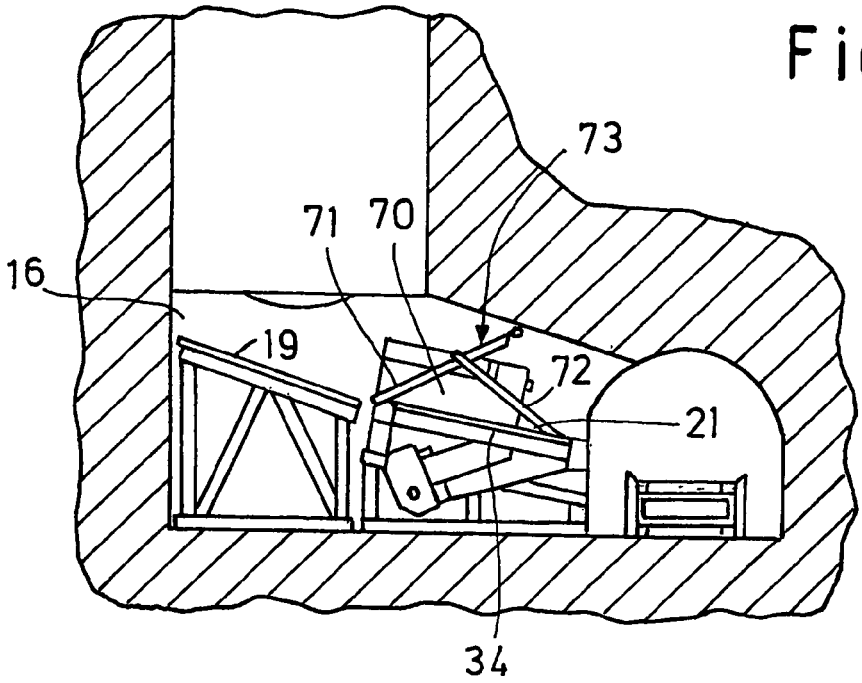
FIG. 14 shows an eighth embodiment of the inventive arrangement for carrying out the inventive method in a representation corresponding to FIG. 3.
Figure 15:
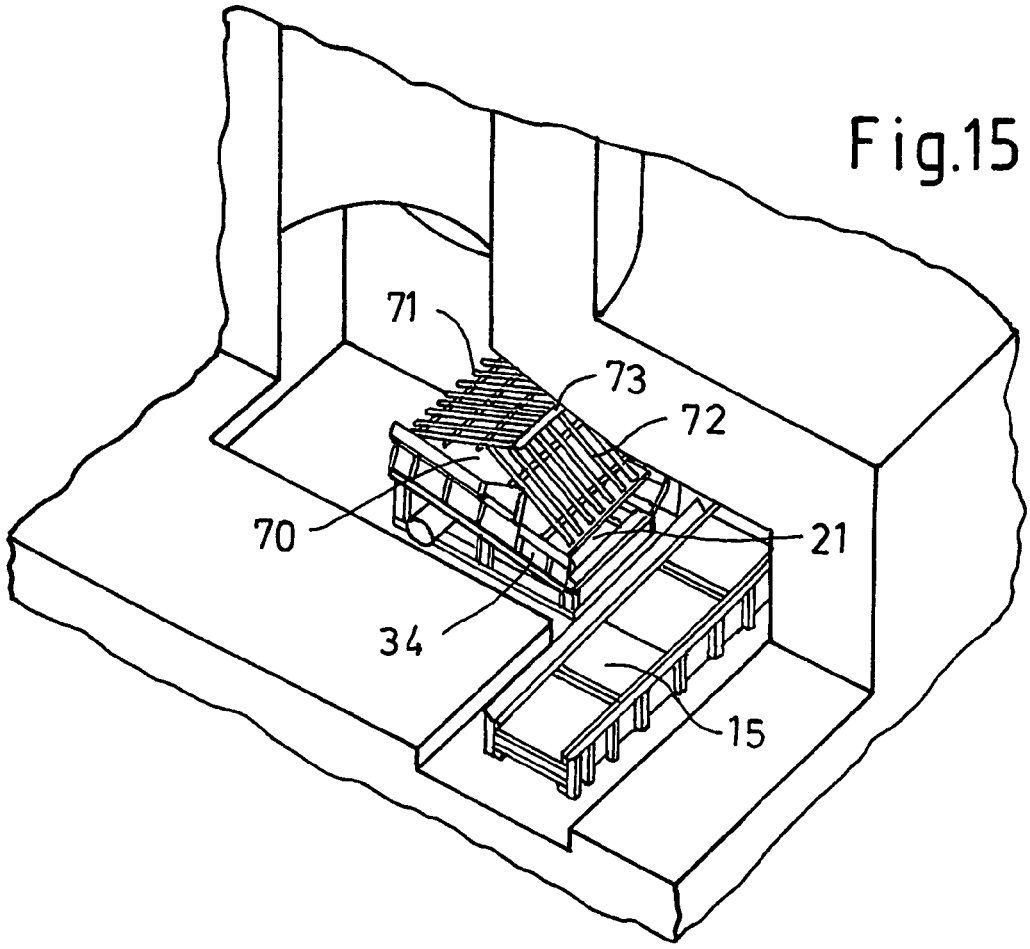
FIG. 15 shows the subject of FIG. 14 in a perspective view obliquely from above.

FIGS. 14 and 15 show very advantageous configuration of the outlet and transfer region of the loading ramp. In this case a lattice sieve 70 (grizzly), which is arranged above the vibrating trough 34 and coupled thereto, is associated with the loading ramp 22 in its lower region. Here the arrangement is such that the lattice sieve 70 includes two sieve screen sections 71, 72 articulated together, the inclination of which relative to the loading ramp 22 is variable, so that the two sections can be erected above the loading ramp in the manner of a roof by means of a hydraulic drive or the like, as can be clearly seen in the drawing. The lattice sieve 70 effects a grading of the won material such that only rocks having a grain size that pass the sieve 70, i.e. fall through its meshes or can pass over the ridge 73 of the "sieve roof", are fed to the extraction conveyor 15. Larger rock lumps are first held back by the sieve and can be reduced by means of a suitable size reduction device, which is not shown in FIGS. 14 and 15 but may be configured, for example, as in one of the other embodiments. Especially in the case of friable won material, size reduction of the initially larger rock pieces will already be effected by their pressure on the bars of the lattice sieve 70, so that in such cases an additional size reduction device may optionally be dispensed with. By lowering the two sieve screen sections 71, 72, erected in the manner of a roof, the extraction chamber can be completely unblocked for large rock pieces also. Conversely, it is also possible with the lattice sieve to effect a blocking of the extraction flow, in that the sieve screens are erected and the sieve is clogged by won material extracted through the funnel, which material then blocks the extraction chamber upstream of the sieve. A separate blocking device may then be dispensed with, in particular if the extraction product is not friable and therefore is not automatically broken up into smaller pieces against the bars of the sieve.

Figure 16:
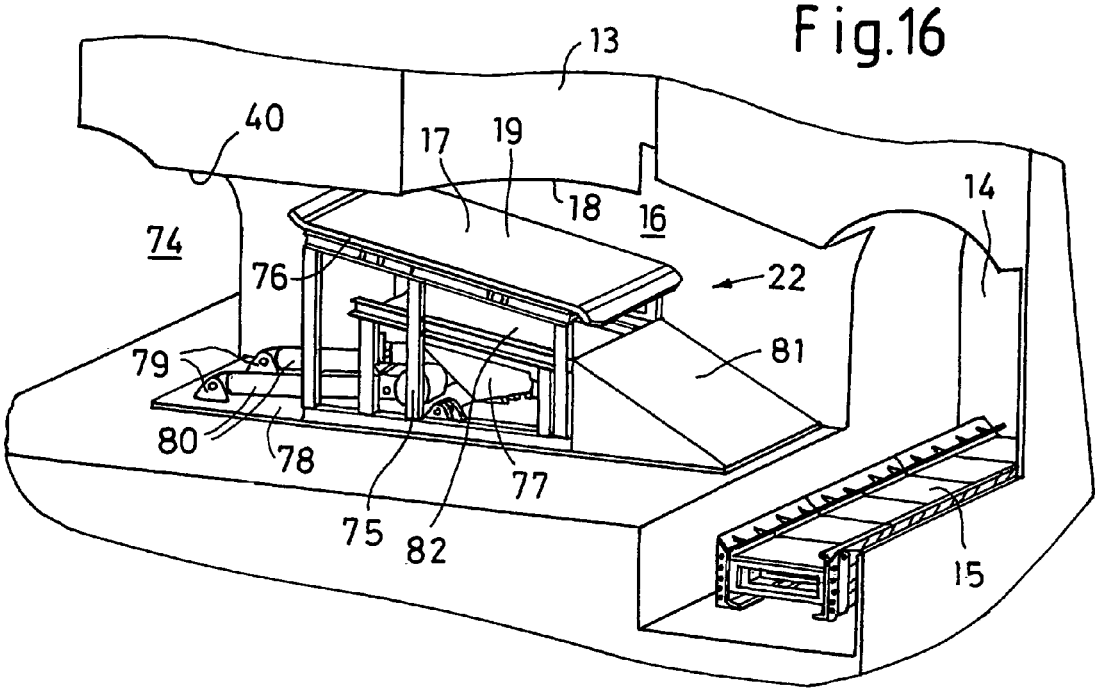
FIG. 16 shows a ninth embodiment of the inventive arrangement for carrying out the inventive method in a perspective representation.
Figure 17:
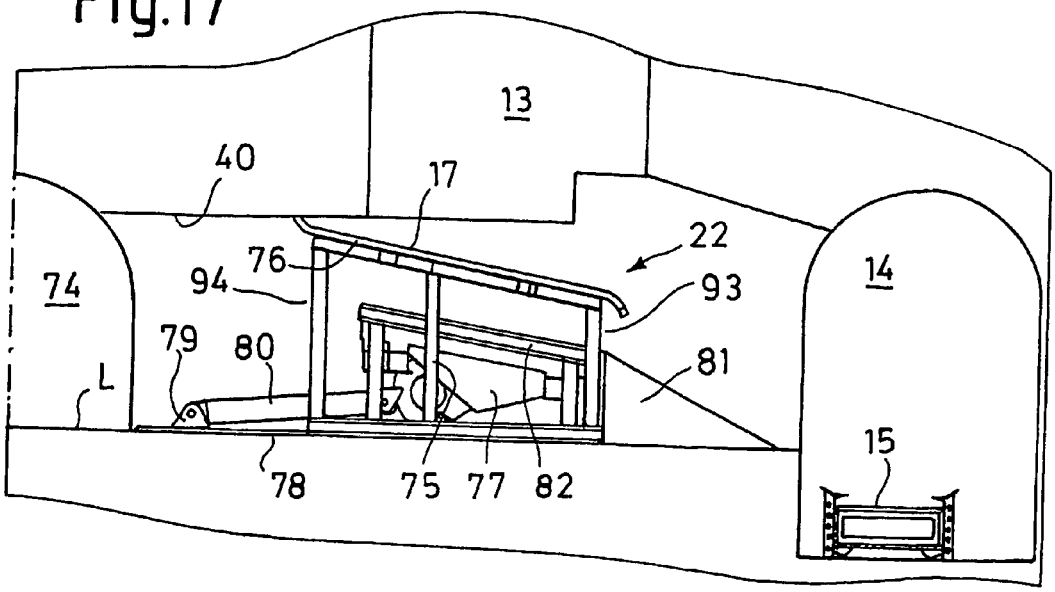
FIG. 17 shows the subject of FIG. 16 in a representation corresponding to FIG. 3.
Figure 18:
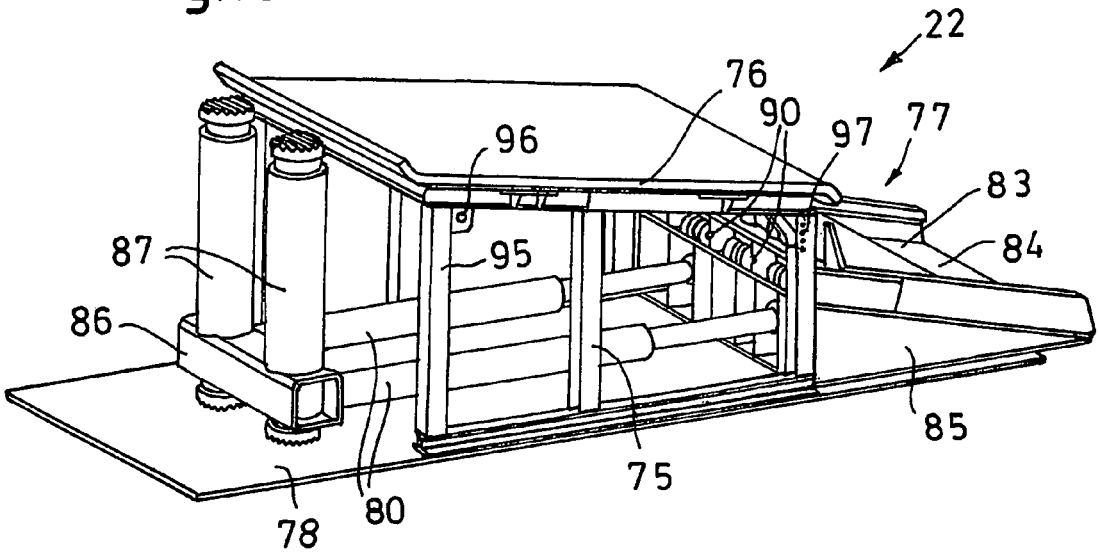
FIG. 18 shows a further embodiment of a loading ramp according to the invention, in particular for use with the embodiment of the inventive arrangement according to FIGS. 16 and 17, in a perspective representation.
Figure 19:
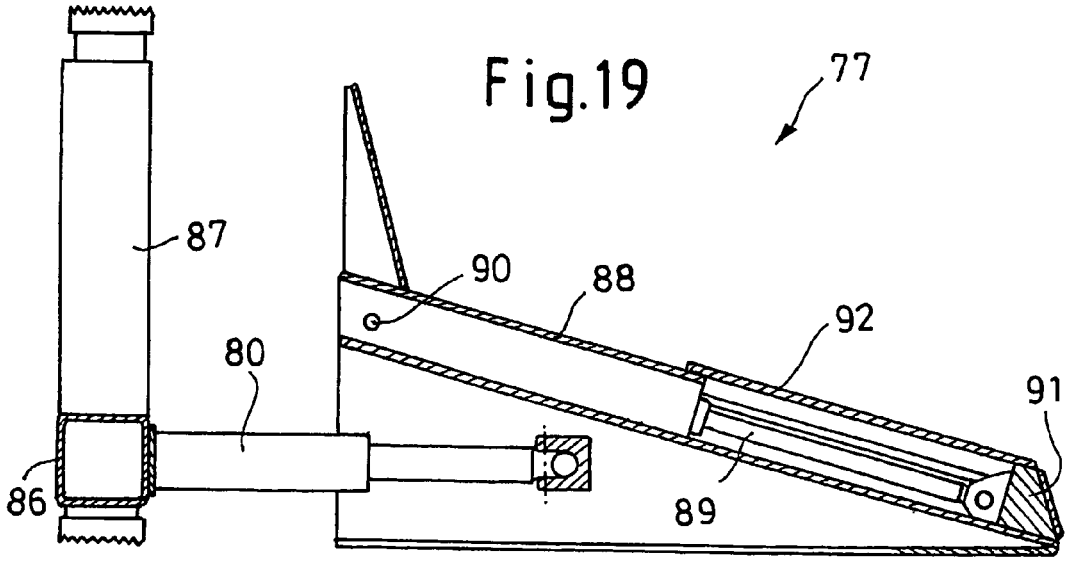
FIG. 19 shows the conveying device of the loading ramp according to FIG. 18 in a longitudinal section.

Finally, FIGS. 16 and 17 show a further embodiment of the arrangement according to the invention, it also being possible for the loading ramp used there to be configured as in FIGS. 18 and 19. In this further embodiment of the inventive arrangement an auxiliary path 74, which is driven parallel to the extraction path 14 at a somewhat higher level than the latter, is arranged behind the loading ramp or ramps 22. The rear end of the extraction chamber 16 housing the loading ramp 22 is in communication with the auxiliary path, as can be clearly seen in the Figures, so that access to the extraction chamber and to the loading ramp arranged therein is provided through the auxiliary path. The loading ramp or parts thereof can be moved into the associated extraction chamber through the auxiliary path, and access for repair purposes is also especially easy from here.

It can be seen that in this embodiment the loading ramp 22 consists substantially of two main elements, a loading ramp frame 75 which, with an impact plate 76 arranged thereon, forms the part of the ramp surface 17 disposed below the extraction funnel 13, and a conveying device 77 which, in the embodiment shown in FIGS. 16 and 17, is still in a rest or pre-installation position below the impact plate 76 in the interior of the loading ramp frame 75.

The loading ramp frame 75 has a base plate 78 resting on the floor L of the extraction chamber 16 and having connection flanges 79 for two thrust cylinders 80 which are articulated at their other ends, on the piston-rod side, to the conveying device 77. When the thrust cylinders 80 are extended, the conveying device 77 is advanced from its pre-installation position represented in FIGS. 16 and 17 towards the extraction path 14, and emerges at the front end of the loading ramp frame 75 below the latter's upper impact plate 76. As this happens, a wedge piece 81 moves under the won material (not shown) lying in front of the loading ramp frame. Said wedge piece 81 is mounted to the front end of the conveying device 77 for correct positioning of said conveying device and raises the won material as the conveying device 77 is advanced, pushing it towards the extraction path, where it falls on to the extraction conveyor 15 disposed lower. When the conveying device 77 is in its desired position, the wedge piece 81 projects into the extraction path 14; it is then removed from the conveying device and can be transported away with the aid of the extraction conveyor 15. The loading ramp is then ready for operation.

In the embodiment represented in FIGS. 16 and 17, the conveying device 77 is an oscillating conveyor 82 in which oscillation exciters (not shown in detail) actuate an oscillation device (not shown) in such a way that won material reaching the conveyor is accelerated and discharged on to the extraction conveyor at the arrest point of the oscillation. Such oscillation conveyors are built comparatively high and can convey effectively only up to a certain depth of the material carpet resting thereon, since a throwing movement is no longer achieved when the maximum depth is exceeded. In most cases, therefore, a device having a thrust blade 83, as illustrated in FIGS. 18 and 19, is advantageous as the conveying device.

The embodiment of the loading ramp 22 according to the invention represented in FIGS. 18 and 19 differs from the loading ramp according to FIGS. 16 and 17 substantially only in the type and the rearward support of its conveying device 77. In this case the conveying device 77 is a comparatively low-built thrust blade 83, which is arranged on the upper face 84 of a wedge loader 85 insertable in or below the won material. The wedge loader 85 can be advanced in the direction of the extraction path by means of two thrust cylinders 80, in order to move it to its correct working position, as is also the case in a similar manner, described above, with the conveying device of the embodiment according to FIGS. 16 and 17. Differently to that embodiment, however, the thrust cylinders 80 of the wedge loader 85 according to FIGS. 18 and 19 do not bear against the base plate 78 of the loading ramp frame 75, but against an expanding frame 86 having two expanding cylinders 87 with which it is braced between the floor L and the roof 40 of the extraction chamber behind the loading ramp frame 75.

The thrust blade 83 itself includes four clearing cylinders 89 (FIG. 19) arranged parallel and side-by-side on the upper face of the wedge loader 85 below a cover plate 88. The clearing cylinders 89 bear at one end against fixed bearings 90 on the wedge loader 85 and are connected at their front end on the piston-rod side to a clearing beam 91, which they move forwards or backwards over the upper face 83 of the wedge loader 85 when pressurised. In this case the arrangement is such that the clearing beam 91 is arranged at the front end of a slide plate 92 resting on the cover plate 88 and slidable thereon, so that the clearing cylinders 89 are always located completely below the cover and slide plates independently of the position of the clearing beam 91, and are thus protected against the won material sliding down.

It can be seen that in the two embodiments represented in FIGS. 16 to 19 the conveying device 77 is arranged on the loading ramp frame 75 at least partially below the ramp surface 17, and projects in its operating state beyond the front end 93 of the loading ramp frame 75 facing towards the extraction conveyor 15. It can also be seen that the conveying device 77 can be advanced as a compact unit from the rear end 94 (FIG. 17) of the loading ramp frame 75 to its front end 93 in the direction of the extraction conveyor 15, and that the conveying device 77 can be installed in the front outlet region of the loading frame 22 from the rear end 94 of the loading ramp 22 below the latter's frame 75.

Finally, it can also be seen in FIG. 18 that the inclination and/or height of the ramp surface 17, or of the impact plate 76 of the loading ramp 22 forming said ram surface 17, and of the loading ramp frame 75, is/are adjustable. For this purpose the ramp surface 17 or the impact plate 76 forming same is pivoted in pivot bearings 96 at its rear end 94 facing towards the auxiliary path 74 to two upright supports 95 of the frame 75, while it is fixable to the loading ramp frame 75 at different heights, by means of a plug-in connection 97, by its front end 93 facing towards the extraction path 14.

The invention is not restricted to the embodiments illustrated and described; rather, a number of changes and additions are possible without departing from the scope of the invention. For example, it is possible in the simplest embodiment of the inventive method and the inventive arrangement to dispense entirely with a loading ramp in the form of a frame arranged in the extraction chamber and to obtain the inclined ramp surface through a suitable inclination of the floor of the extraction chamber, i.e. to drive the inclined ramp surface directly into the rock. This especially inexpensive variant of the invention may be used in particular where a precisely defined angle of inclination, and in particular a change of inclination, is not important, at least in partial areas of the ramp surface. The blocking flap of the blocking device may also be suspended directly from the roof 40 of the extraction path, while corresponding in its function and direction of movement to the swing gate 35 of the third embodiment. Instead of a hydraulic drill hammer as the size reduction device, a crusher, for example, an impact roll crusher or the like arranged in the outlet region of the ramp upstream of the transfer to the conveyor, may be used in individual cases.

The invention claimed is:

1. An arrangement for extracting extraction products in underground mining operations using the caving method, the extraction product being extractable after collapsing in a working gate area, the arrangement comprising:

at least one extraction funnel arranged in the bottom rock of the working gate to receive the collapsed extraction product and directing the extraction product to an extraction path driven below the gate;

an extraction conveyor arranged in the extraction path to transport the extraction product away; and a loading ramp having a ramp surface aligned substantially transversely to a conveying direction of the extraction conveyor and inclined towards the extraction conveyor, a first end of the ramp surface being located below the extraction funnel and second lower end of the ramp surface forming an outlet towards the extraction conveyor;

wherein the loading ramp includes or forms in its outlet region a conveying device conveying in the direction of the extraction conveyor, and wherein the conveying device is a vibrating trough.

2. An arrangement according to claim 1, comprising an auxiliary path arranged behind the loading ramp substantially parallel to the extraction path, through which auxiliary path the loading ramp is accessible from the rear.

3. An arrangement according to claim 1, wherein the loading ramp has a loading ramp frame arranged in the region below the extraction funnel.

4. An arrangement according to claim 1, wherein the loading ramp or a loading ramp frame thereof includes a base plate arranged on the floor.

5. An arrangement according to claim 4, wherein the base plate can be braced against the rock by means of at least one jack.

6. An arrangement according to claim 1, wherein the inclination of the ramp surface varies over its length, the ramp surface below the extraction funnel having a greater inclination than in the outlet region to the extraction conveyor.

7. An arrangement according to claim 1, wherein the ramp surface, or an impact plate forming the ramp surface is adjustable in inclination and/or height.

8. An arrangement according to claim 7, wherein the ramp surface, or the impact plate is pivoted at its rear end facing towards an auxiliary path arranged behind the loading ramp substantially parallel to the extraction path, through which auxiliary path the loading ramp is accessible from the rear.

9. An arrangement according to claim 7, wherein the ramp surface, or the impact plate is fixable at different heights to the loading ramp frame by a plug-in connection at its front end facing towards the extraction path.

10. An arrangement according to claim 1, wherein the loading ramp is provided with a blocking device.

11. An arrangement according to claim 10, wherein the blocking device is arranged in the outlet region of the loading ramp.

12. An arrangement according to claim 10, wherein the blocking device is arranged upstream of the outlet region of the loading ramp.

13. An arrangement according to claim 11, wherein the blocking device consists substantially of at least one swivellable blocking flap.

14. An arrangement according to claim 13, wherein the swivel drive of the blocking flap consists substantially of at least one hydraulic cylinder.

15. An arrangement according to claim 13, wherein the blocking flap is swivellable about a substantially horizontal axis.

16. An arrangement according to claim 15, wherein the blocking flap is formed by a section of the ramp surface in the outlet region of the latter.

17. An arrangement according to claim 15, wherein the blocking flap is formed substantially by a closure composed of segments or sectors, which includes a curved dam wall separating the ramp surface from the outlet region if required, which dam wall is swivellable up and down about the horizontal axis by at least one swivel arm.

18. An arrangement according to claim 13, wherein the blocking flap is swivellable about a substantially vertical axis and is formed by at least one gate flap swivellable in the manner of a gate above the outlet region of the ramp surface.

19. An arrangement according claim 13, wherein the blocking flap is formed by at least one swing gate extending downwardly from the roof of the extraction path or from a support frame, the swing gate being pivoted at its upper end about an approximately horizontal pivot axis disposed substantially parallel to the extraction conveyor.

20. An arrangement according to claim 10, wherein the blocking device comprises a sectional gate running in lateral guide rails and comprising a plurality of blocking segments articulated to one another.

21. An arrangement according to claim 10, wherein the blocking device comprises a roll-up gate that can be rolled on to a horizontal shaft arranged above the ramp surface and comprises a plurality of blocking segments articulated to one another.

22. An arrangement according to claim 10, wherein the blocking device includes, or is formed by, at least one swing flap journalled in pendulum fashion about a horizontal axis.

23. An arrangement according to claim 22, wherein a plurality of swing flap elements are articulated to one another to form a swing flap curtain which forms the blocking device.

24. An arrangement according to claim 1, wherein the conveying device is arranged on the loading ramp frame at least partially below the ramp surface and projects in its operating state from the front end of the loading ramp frame facing towards the extraction conveyor.

25. An arrangement according to claim 1, wherein the conveying device can be advanced as a compact unit from the rear end of the loading ramp frame to its front end in the direction towards the extraction conveyor.

26. An arrangement according to claim 1, wherein the conveying device can be installed in the front outlet region of the loading frame from the rear end of the loading ramp through and below the loading ramp frame.

27. An arrangement according to claim 1, wherein a size reduction device for extraction products is associated with the loading ramp.

28. An arrangement according to claim 27, wherein the size reduction device comprises a crusher arranged in the outlet region of the loading ramp.

29. An arrangement according to claim 27, wherein the size reduction device comprises a chisel hammer or a drill hammer arranged above the ramp surface and acting in the outlet region of the loading ramp.

30. An arrangement according to claim 29, wherein the chisel hammer or drill hammer is suspended from the roof of the extraction path or from a rail track arranged thereon and is displaceable in the longitudinal direction of the extraction conveyor at least over the width of the loading ramp.

31. An arrangement according to claim 1, comprising a lattice sieve is associated with the loading ramp.

32. An arrangement according to claim 31, wherein the lattice sieve is arranged above the vibrating trough.

33. An arrangement according to claim 31, wherein the lattice sieve is coupled to the vibrating trough.

34. An arrangement according to claim 31, wherein the lattice sieve includes at least one sieve screen the inclination of which is variable relative to the loading ramp.

35. An arrangement according to claim 34, wherein the lattice sieve includes two sieve screen sections articulated to one another that can be erected above the loading ramp in the manner of a roof.

36. An arrangement according to claim 1, wherein the extraction conveyor is arranged below the outlet region of the loading ramp.

37. An arrangement according to claim 1, wherein the loading ramp is provided at the free end of its outlet region with a loading flap extending over a side wall of the extraction conveyor.

38. An arrangement according to claim 1, wherein the extraction conveyor is a drag link conveyor or a vibrating trough conveyor.

39. An arrangement for extracting extraction products in underground mining operations using the caving method, the extraction product being extractable after collapsing in a working gate area, the arrangement comprising:

at least one extraction funnel arranged in the bottom rock of the working gate to receive the collapsed extraction product and directing the extraction product to an extraction path driven below the gate;

an extraction conveyor arranged in the extraction path to transport the extraction product away; and a loading ramp having a ramp surface aligned substantially transversely to a conveying direction of the extraction conveyor and inclined towards the extraction conveyor, a first end of the ramp surface being located below the extraction funnel and second lower end of the ramp surface forming an outlet towards the extraction conveyor;

wherein the loading ramp is provided with a blocking device arranged in the outlet region of the loading ramp, wherein the blocking device consists substantially of at least one swivellable blocking flap, and wherein the blocking flap is swivellable about a substantially vertical axis and is formed by at least one gate flap swivellable in the manner of a gate above the outlet region of the ramp surface.

40. An arrangement according to claim 39, wherein the blocking device includes at least one hydraulic cylinder swivel drive of the blocking flap.

41. An arrangement for extracting extraction products in underground mining operations using the caving method, the extraction product being extractable after collapsing in a working gate area, the arrangement comprising:

at least one extraction funnel arranged in the bottom rock of the working gate to receive the collapsed extraction product and directing the extraction product to an extraction path driven below the gate;

an extraction conveyor arranged in the extraction path to transport the extraction product away; and a loading ramp having a ramp surface aligned substantially transversely to a conveying direction of the extraction conveyor and inclined towards the extraction conveyor, a first end of the ramp surface being located below the extraction funnel and second lower end of the ramp surface forming an outlet towards the extraction conveyor;

wherein the loading ramp is provided with a blocking device, and wherein the blocking device comprises a sectional gate running in lateral guide rails and comprising a plurality of blocking segments articulated to one another.

42. An arrangement for extracting extraction products in underground mining operations using the caving method, the extraction product being extractable after collapsing in a working gate area, the arrangement comprising:

at least one extraction funnel arranged in the bottom rock of the working gate to receive the collapsed extraction product and directing the extraction product to an extraction path driven below the gate;

an extraction conveyor arranged in the extraction path to transport the extraction product away;

a loading ramp having a ramp surface aligned substantially transversely to a conveying direction of the extraction conveyor and inclined towards the extraction conveyor, a first end of the ramp surface being located below the extraction funnel and second lower end of the ramp surface forming an outlet towards the extraction conveyor;

wherein the loading ramp is provided with a blocking device, and wherein the blocking device comprises a roll-up gate that can be rolled on to a horizontal shaft arranged above the ramp surface and comprises a plurality of blocking segments articulated to one another.

43. An arrangement for extracting extraction products in underground mining operations using the caving method, the extraction product being extractable after collapsing in a working gate area, the arrangement comprising:

at least one extraction funnel arranged in the bottom rock of the working gate to receive the collapsed extraction product and directing the extraction product to an extraction path driven below the gate;

an extraction conveyor arranged in the extraction path to transport the extraction product away;

a loading ramp having a ramp surface aligned substantially transversely to a conveying direction of the extraction conveyor and inclined towards the extraction conveyor, a first end of the ramp surface being located below the extraction funnel and second lower end of the ramp surface forming an outlet towards the extraction conveyor; and an auxiliary path arranged behind the loading ramp substantially parallel to the extraction path, through which auxiliary path the loading ramp is accessible from the rear.

44. An arrangement according to claim 43, wherein the loading ramp has a loading ramp frame arranged in the region below the extraction funnel.

45. An arrangement according to claim 43, wherein the loading ramp or a loading ramp frame thereof includes a base plate arranged on the floor.

46. An arrangement according to claim 43, wherein the inclination of the ramp surface varies over its length, the ramp surface below the extraction funnel having a greater inclination than in the outlet region to the extraction conveyor.

47. An arrangement according to claim 43, wherein the ramp surface, or an impact plate forming the ramp surface is adjustable in inclination and/or height.

48. An arrangement according to claim 43, wherein the loading ramp is provided with a blocking device.

49. An arrangement according to claim 43, wherein the loading ramp includes or forms in its outlet region a conveying device conveying in the direction of the extraction conveyor, and wherein the conveying device is a vibrating trough.

50. An arrangement according to claim 43, wherein a size reduction device for extraction products is associated with the loading ramp.

51. An arrangement according to claim 43, comprising a lattice sieve is associated with the loading ramp.

52. An arrangement according to claim 43, wherein the extraction conveyor is arranged below the outlet region of the loading ramp.

53. An arrangement according to claim 43, wherein the loading ramp is provided at the free end of its outlet region with a loading flap extending over a side wall of the extraction conveyor.

54. An arrangement according to claim 43, wherein the extraction conveyor is a drag link conveyor or a vibrating trough conveyor.

* * * * *